United States Patent [19]

Schenz

[11] Patent Number: 4,744,854

[45] Date of Patent: May 17, 1988

[54] APPARATUS FOR CONTINUOUS MANUFACTURE OF AN ENDLESS STRIP OF CHIPBOARD

[75] Inventor: Manfred Schenz, Gittelde, Fed. Rep. of Germany

[73] Assignee: Wilhelm Mende GmbH, Fed. Rep. of Germany

[21] Appl. No.: 841,880

[22] Filed: Mar. 20, 1986

[30] Foreign Application Priority Data

Mar. 22, 1985 [DE] Fed. Rep. of Germany ..... 3510460
Nov. 22, 1985 [DE] Fed. Rep. of Germany ..... 3541286

[51] Int. Cl.[4] ..... B27N 3/26; B30B 3/04

[52] U.S. Cl. ..... 156/498; 100/93 RP; 100/153; 156/62.2; 156/501; 156/555; 156/583.5; 425/373

[58] Field of Search ..... 156/62.2, 501, 555, 156/583.5, 498; 100/93 RP, 153, 215; 425/373

[56] References Cited

U.S. PATENT DOCUMENTS

| | | | |
|---|---|---|---|
| 3,039,137 | 6/1952 | Smith et al. | 425/373 |
| 3,450,030 | 6/1969 | Hutz | 100/215 |
| 3,565,725 | 2/1971 | Siempelkamp | 425/373 |
| 3,737,351 | 6/1973 | Ettel | 156/62.2 |
| 3,994,765 | 11/1976 | Brinkmann et al. | 156/555 |
| 4,253,902 | 3/1981 | Yada | 156/584 |
| 4,310,365 | 1/1982 | Elliott et al. | 156/583.1 |
| 4,358,333 | 11/1982 | Holland-Letz | 156/584 |

FOREIGN PATENT DOCUMENTS

| | | |
|---|---|---|
| 343882 | 6/1978 | Austria . |
| 802360 | 2/1951 | Fed. Rep. of Germany . |
| 2034853 | 7/1974 | Fed. Rep. of Germany . |
| 2458409 | 6/1975 | Fed. Rep. of Germany . |
| 2710000 | 9/1978 | Fed. Rep. of Germany . |

OTHER PUBLICATIONS

Soine, "Kontinuierliche Pressvcerfahren in der Spanplattenindustrie—die Anfänge bis zum Mende-Verfahren".

*Primary Examiner*—Michael Wityshyn
*Attorney, Agent, or Firm*—Allegretti, Newitt, Witcoff & McAndrews, Ltd.

[57] ABSTRACT

An apparatus for the continuous manufacture of an endless strip of thin chipboard includes means for depositing wood chips mixed with a bonding agent onto a horizontally-disposed section of a continuously revolving pretensioned conveyor belt. This apparatus is further provided with a heated compression drum adjacent the discharge end of the conveyor belt. An endless steel belt partially encircles the compression drum surface to provide a compression gap between the steel belt and the drum surface. The improvement comprises a first deflector roller mounted adjacent the point where the chips enter the gap; a second deflector roller beneath said depositing means; and the conveyor belt being endless, made from textile material and trained around the first and second deflector rollers to convey the chips to the gap.

20 Claims, 3 Drawing Sheets

APPARATUS FOR CONTINUOUS MANUFACTURE OF AN ENDLESS STRIP OF CHIPBOARD

BACKGROUND OF THE INVENTION

1. Field of Invention

The present invention concerns an apparatus for the continuous manufacture of an endless strip of thin chipboard.

2. Description of Related Art

An apparatus for the continuous manufacture of an endless strip of thin chipboard is disclosed in document DE-PS No. 20 34 853 in which a conveyor belt running beneath a means for depositing wood chips consists of a steel belt wound around a heated compression roller. On account of the high specific heat of the steel belt, the heat absorbed by the belt, as it winds around the heated compression roller, is transmitted to the deflector rollers over which the belt is run and is dissipated in the surrounding air by radiant and cooling effects. This process results in some undesirable heat losses. The heat dissipation also is, however, a necessary part of the process and has to be reinforced by cooling in the vicinity of the depositing means. There, the temperature of the steel belt must not be allowed to exceed the level at which the bonding agent would not act to bond the chips which are treated with the bonding agent. As the relatively long steel belt cools off, irregular cooling of the edge zones compared with the central area occurs and may induce stresses in the steel, premature fractures or, at the very least, cracking. Because the return of the steel belt to the depositing means requires use of a lengthy steel belt which has a high unit cost per foot of belt, a substantial level of investment is needed in this regard.

An apparatus of this type is also described in document DE-OS No. 27 10 000 in which the conveyor belt running beneath the depositing means consists of two steel belts. A first belt is wound around a compression roller. A second steel belt is an endless belt separate from the first steel belt and does not have to resist such high traction forces as the first steel belt does. The second belt can thus be made of lower grade steel at lower cost. A further way of realizing possible savings in this area is that since at least two deflector rollers are used with this steel belt, smaller diameter rollers can be used. The diameter of these rollers is, however, large enough to leave a long gap between the last deflector roller and the counter-roller, as seen in operation. As a result, a lengthy guide piece is provided with which the particle mat, after dispersion and pressing, can be guided over the section between an upper tangential plane of the last deflector roller and the counter-roller. However, the particle mat exerts such a high level of friction on this long guide piece that deformation occurs in the pressed particle mat. The friction tends to alter the internal structure of the individual chips and to destroy the bonds between the chips resulting from the prepressing process. This results in a finished chipboard with poor mechanical qualities.

The purpose of the present invention is thus to provide an apparatus that avoids the disadvantages of the above second disclosure and can be manufactured at even lower cost. Its operation involves the creation of less heat while at the same time maintains the quality of the finished chipboard.

The teaching embodied in this invention provides a solution to match these requirements.

SUMMARY OF THE INVENTION

An apparatus for the continuous manufacture of an endless strip of thin chipboard includes means for depositing wood chips mixed with a bonding agent onto a horizontally-disposed section of a continuously revolving pretensioned conveyor belt. This apparatus is further provided with a heated compression drum adjacent the discharge end of the conveyor belt. An endless steel belt partially encircles the compression drum surface to provide a compression gap between the steel belt and the drum surface. Counterpressure is exerted by a counter-roller which serves to press the steel belt onto the drum surface as the belt contacts the drum. The compression drum is sufficiently large in diameter to prevent the separation of the chips when the finished board is straightened out. The improvement comprises a first deflector roller mounted adjacent the point where the chips enter the gap; a second deflector roller beneath said depositing means; and the conveyor belt being endless, made from textile material and trained around the first and second deflector rollers to convey the chips to the gap. This apparatus can be made at low cost, its energy consumption is low and it will produce finished chipboard of high quality.

BRIEF DESCRIPTION OF THE DRAWINGS

The background of the invention and its departure from the art will be further described hereinbelow with reference to the accompanying drawings, wherein.

DETAILED DESCRIPTION OF THE INVENTION

Figure 1:
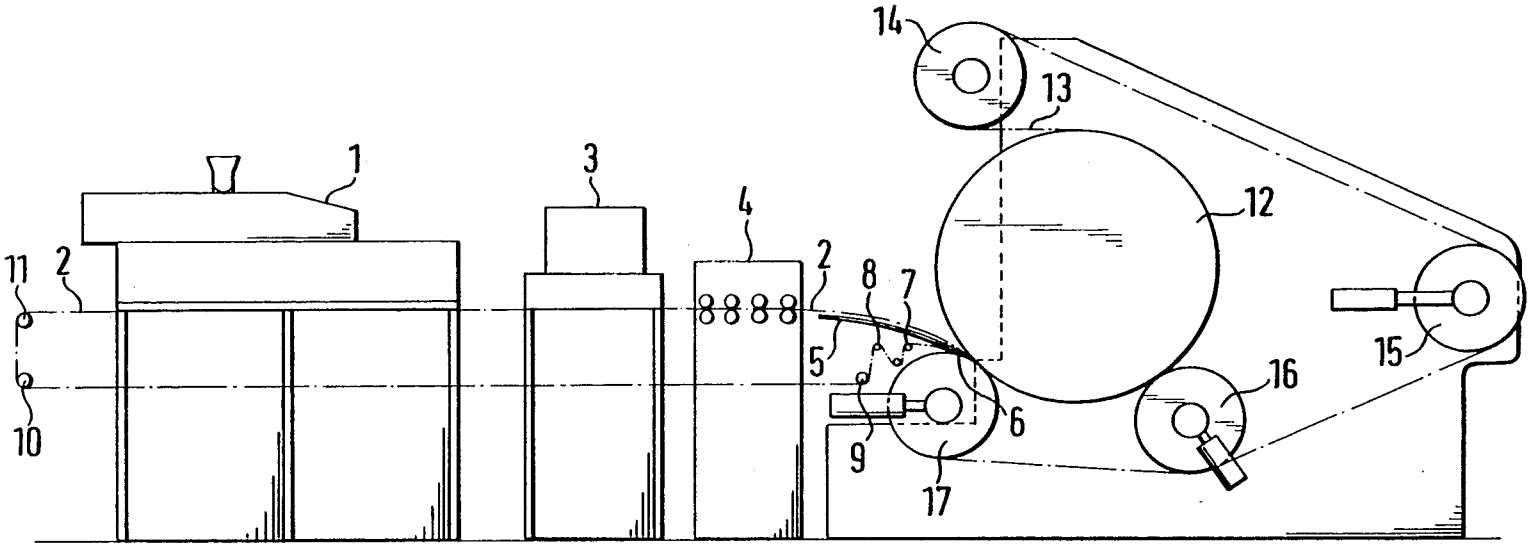
FIG. 1 is a schematic representation of an apparatus of the present invention.

The basic concept of the present invention consists of employing two different belts for different functions to be performed near the compression drum and the means for depositing wood chips. For the conveyor belt close to the depositing means, a flexible textile belt, which may be made of natural and/or synthetic fiber, is used rather than steel. This belt is capable of bending around a very small diameter. It can be trained around a deflector roller located very close to and above the steel belt, adjacent the point at which the steel belt contacts the compression drum, thus allowing the particle mat to be transferred from the flexible textile belt to the steel belt. For this reason, the particle mat has only to cover an extremely short distance without a moving support beneath it. It is, in principle, possible for the prepressed particle mat to cover this route without support and no friction can occur. At the same time, distortion, deformation and deterioration of the quality of the finished chipboard can be avoided.

In another embodiment of the present invention, a support rail is provided in the transfer area between the deflector roller of the textile conveyor belt and the steel belt or, in the case of a further embodiment, between the deflector roller and the counter-roller. This support rail can be kept sufficiently short so that the movement of the prepressed particle mat maintains a low level of friction created by the load on the upper surface of this support rail thereby avoiding any risk of distortion of the particle mat.

A further advantage to using a textile conveyor belt is the ability to employ a high voltage heating device to preheat the particle mat more efficiently because the textile belt can be made from a material which has extremely low dielectric losses. This advantage also brings with it an extremely regular pattern of heat distribution throughout the particle mat. Since the conveyor belt receives practically no heat from the heating device and the textile material of the belt has low specific heat, heat losses are further reduced. The teaching of the present invention brings with it thermal energy savings of up to about 50%. The deflector roller preferably comprises the tapered edge of a support table for the flexible belt. The support table can have an arched configuration to improve the transfer and conformity to the curvature of the counter-roller.

Depending on the type of textile conveyor belt employed, the diameter of the deflector roller may be extremely small. The deflector may consist of one roller with a small diameter or a plurality of smaller rollers so that no friction, and thus no degradation, of the textile conveyor belt can occur. The conveyor belt preferably curves gradually downward adjacent the deflector roller. This facilitates the transfer from the textile conveyor belt to the steel belt by using gravity to assist in the process.

The transfer from the textile conveyor belt to the steel belt is also facilitated in another embodiment of the instant invention in which means for compressing the wood chips is arranged between the depositing means and the deflector roller to partially cure the bonding agent mixed with the wood chips. This ensures that the particle mat is sufficiently bonded by the time it reaches the transfer area to avoid any risk of structural degradation. By the same token, the positioning of a heating device, preferably a high voltage heating device, between the depositing means and the compressing means will also have a positive effect. This arrangement facilitates prepressing and enhances both the performance and structure of the particle mat to such an extent that no structural degradation of the prepressed particle mat occurs in the transfer zone.

The heating device for preheating the particle mat preferably operates to heat the mat to a temperature of about 50° to about 60° C. This allows application of an adequate amount of heat without resulting in permanent setting of the bonding agent with which the chips are treated.

According to another embodiment of the present invention, the compressing means is sufficiently sized or arranged so that the particle mat fed to the compressing means is compressed by less than 50% and preferably less than 10%. This very low degree of compression sufficiently ensures that the prepressed particle mat can be transferred from the textile conveyor belt to the steel belt without any degradation of the structure of the mat. At the same time, permanent bonding of the particles can be avoided before they are introduced into the compression gap between the compression drum and the counter-roller. Otherwise, there would be the risk of breaking the bonds as the mat runs into the compression gap.

In a further embodiment of this invention, a support rail is provided for the support of the partcle mat wedged between the deflector roller or rollers, the steel belt and the counter-roller. The support rail is preferably provided with a cooling channel for cooling purposes. This arrangement avoids any heat rise in the support rail as a result of any radiant heat from the steel belt or from the counter-roller and the direct contact of the layer of the particle mat with the support rail. It also avoids any hardening of the bonding agent before the particle mat is finally compressed.

Lastly, according to a still further embodiment of the present invention, means are provided for feeding a paper strip gradually upward or downward onto the steel belt adjacent the compression gap. The paper strip, which covers the surface of the compressed board product, is fed right into the compression gap, and is rendered possible by using separate steel and textile conveyor belts. In this way, it is not necessary for the paper strip to be fed from beyond the depositing means which would involve a paper strip of extreme length to reach the compression gap. If a lengthy paper strip were required, it might become twisted which could result in changes in the structure of the poured particle mat and thus degrade the quality of the finished product. The shorter paper strip used in this invention avoids such problems.

The present invention may be illustrated with reference to the drawings. In the apparatus according to FIG. 1, wood chip particles mixed with a bonding agent are dispersed onto a horizontally-disposed pretensioned textile conveyor belt 2 by way of means for depositing wood chips 1. The textile conveyor belt is trained beneath the depositing means 1, through a high voltage device 3, through means for compressing said chips 4, above an arched support table 5, around a deflector edge 6 and around deflector rollers 7 through 11 returning to the depositing means. The endless conveyor belt is trained around the deflector rollers to convey said chips to the compression gap.

The apparatus for final pressing purposes is provided with a compression drum 12 around which an endless steel belt 13 is partially wound. The steel belt is trained around a deflector roller 14, a tensioning roller 15, a pressure roller 16 and a counter-roller 17. The counter-roller provides pressure against the steel belt 13 and the compression drum surface forming a compression gap between the steel belt and drum surface. the pressure applied at the point where said chips enter the compression gap is maintained as a result of the tension of the steel belt 13 and sufficiently continues to set the bonding agent until the chips leave the compression drum 12. The textile conveyor belt is trained around the deflector edge 6 and lies in a plane tangent to the counter-roller adjacent the point where said chips enter the compression gap.

The deflector edge 6 of the support table 5 is tapered and mounted adjacent the compression gap between the counter-roller 17 and the compression drum 12, immediately above the counter-roller 17. The prepressed particle mat directly lying on the textile conveyor belt 2 can be deposited onto the upper surface of the steel belt 13 without any substantial change in direction and passed through the compression gap. During operation of this apparatus, particles treated with bonding agent are continuously deposited by way of the depositing means 1 onto the textile conveyor belt which is in constant motion. As the chips proceed through the high voltage heating device 3, the particle mat formed in the process is heated to a temperature which does not harm the textile conveyor belt 2 and is below the setting temperature of the bonding agent. This preheating process enhances the compressibility of the particle mat in the subsequent compressing means 4. After leaving the compressing means 4, the particle mat is thinner and is adequately hardened to be transfered from the textile conveyor belt 2 to the steel belt 13 in the area of the deflector edge 6 without any deleterious effects on its structure. This is, of course, based on the assumption that the textile conveyor belt 2 and the steel belt 13 are moving at essentially the same speeds.

Figure 2:
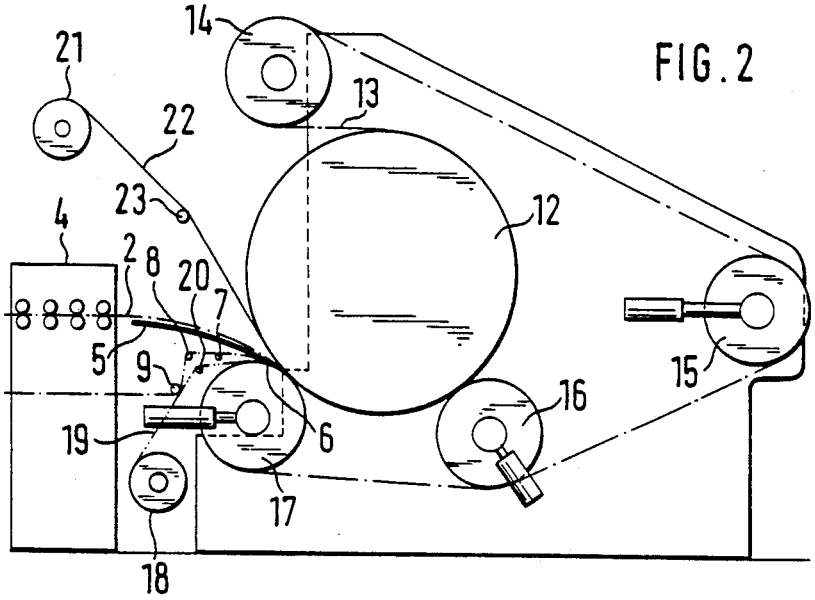
FIG. 2 shows the right hand end of the apparatus of FIG. 1 including a further embodiment of the invention.

FIG. 2 shows the right hand side of FIG. 1 where means for feeding a paper strip such as a coil 18 is provided, from which one of the paper strips 19 is upwardly trained around a deflector roller 20 onto the steel belt 13 adjacent the compression gap between the compression drum 12 and the counter-roller 17. From the area prior to the point at which the paper strip 19 is picked up by the steel belt 13 to the compression gap, the paper strip is firmly supported by the steel belt wound around the counter-roller 17, so that no relative movement can take place between them. In addition, the particle mat is already compressed at this stage so that the paper strip will not be further elongated, which would otherwise degrade the particle mat. In this way, the paper strip can be applied to the chipboard directly in the compression gap during the production process, without suffering any degradation.

In the same manner, a coil 21 can be provided on the top side as well, from which a second paper strip 22 is downwardly trained around a deflector roller 23 to the compression drum 12 adjacent the compression gap.

Figure 3:
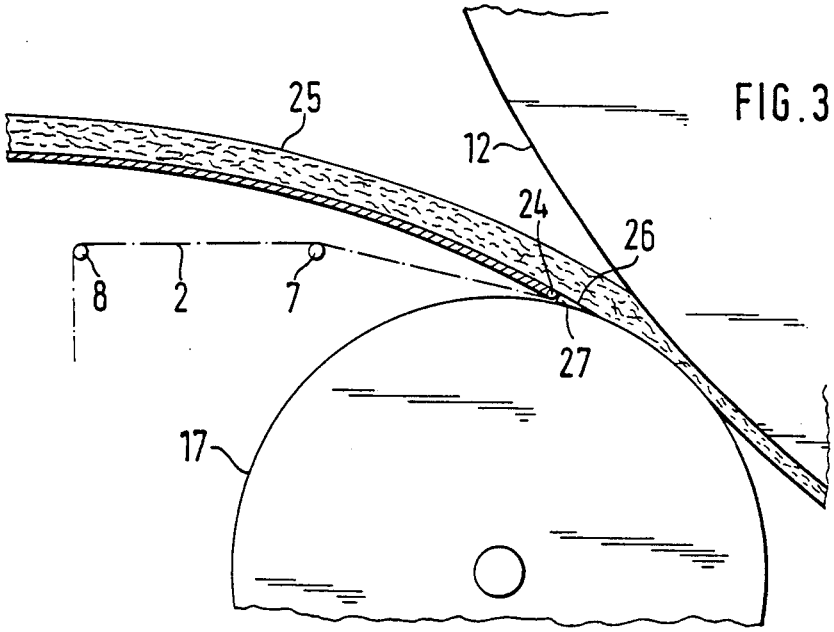
FIG. 3 shows an enlarged section of FIG. 1 adjacent the compression gap between the compression drum 12 and counter-roller 17.

FIG. 3 shows an enlarged section of FIG. 1 adjacent the compression gap between the comprssion drum 12 and the counter-roller 17. At the end of table 5, small deflector rollers 24 are provided around which the textile belt is trained. The diameter of these rollers is about 6 mm to about 20 mm, preferably about 6 mm to about 10 mm, and their spindle is maintained against the leading edge of the table 5 by means of comblike projections between the rollers. A prepressed particle mat 25 supported on the textile conveyor belt 2 is conveyed to the compression gap. Located adjacent to the deflector rollers 24 is a flat support rail 27 of triangular cross section having an upper chip-bearing surface 26 adjacent to said gap. Said chip-bearing surface lies in a plane tangent to the deflector rollers 24. In addition, the chipbaring surface 26 lies in a plane tangent to the counterroler 17 adjacent the point where the prepressed particle mat 25 entered the compression gap.

Figure 4:
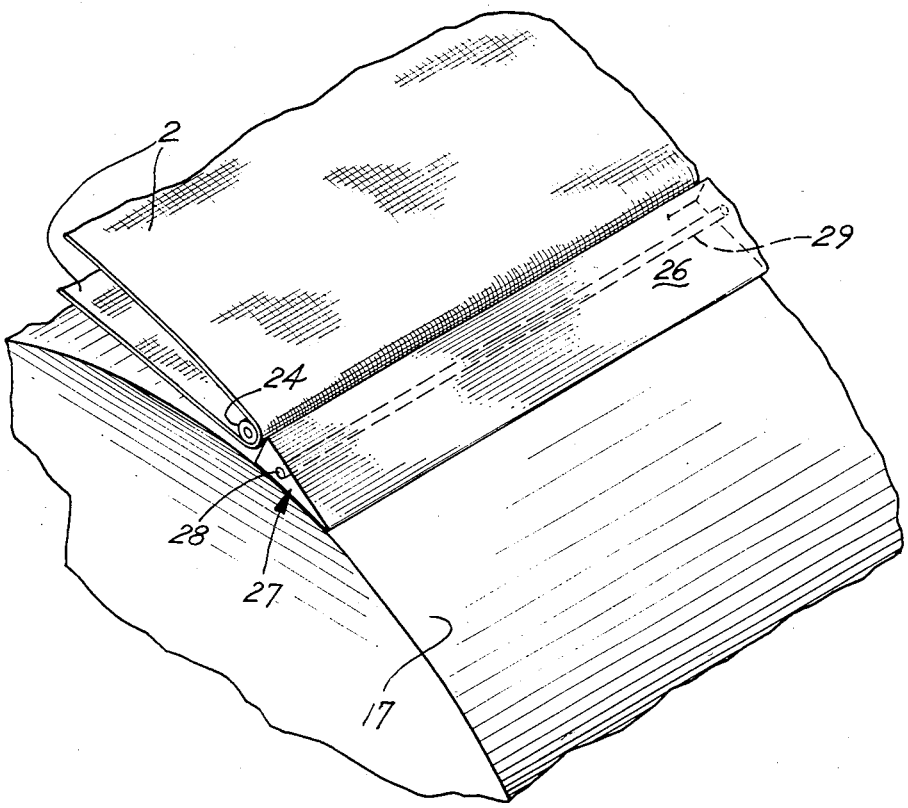
FIG. 4 is a perspective view of a support rail 27 illustrating a cooling channel 29 in the support rail.
Figure 4A:
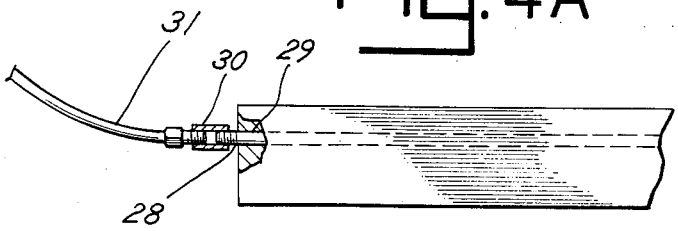
FIG. 4A shows a top view of the support rail 27 further illustrating the cooling channel 29 in the support rail.

FIG. 4 shows at least one cooling channel 29 supplied in the support rail 27 through which a coolant, preferably water, is circulated. FIG. 4A shows a top view of the support rail 27 providing means for suppling a coolant 31 from a source to the cooling channel. The end of the conduit 28 connects to the supplying means by way of means for attaching the source 30.

While in the foregoing there has been provided a detailed description of preferred embodiments of the present invention, it is to be understood that all equivalents obvious to those having skill in the art are to be included within the scope of the invention as claimed.

I claim:

1. In an apparatus for the continuous manufacture of an endless strip of thin chipboard having a horizontally-disposed pretensioned conveyor belt;

means for depositing wood chips mixed with a bonding agent onto a horizontal section of said conveyor belt;

a heated compression drum adjacent the discharge end of said conveyor belt;

an endless steel belt encircling a portion of the drum surface to provide a compression gap between the steel belt and the drum surface; and a counter-roller providing pressure against said steel belt and said drum surface, the improvement comprising:

a first deflector roller mounted adjacent the point where said chips enter said gap;

a second deflector roller beneath said depositing means; and said conveyor belt being endless, made from textile material and trained around said first and second deflector rollers to convey said deposited chips to said gap, wherein said conveyor belt and the portion of said counter-roller located between the discharge end of said conveyor belt and the compression gap define a support path for said chips, said conveyor belt and said portion of said counter-roller being in close proximity to each other such that said support path forms a substantially continuous arcuately curved surface that supports said chips at substantially all times as said chips are conveyed from said conveyor belt to said gap.

2. The apparatus according to claim 1, wherein said first deflector roller comprises the tapered edge of a support table mounted adjacent said gap.

3. The apparatus according to claim 2, wherein the support table has an arched configuration.

4. The apparatus according to claim 1, wherein said first deflector roller has a small diameter.

5. The apparatus according to claim 4, wherein said apparatus includes a plurality of small deflector rollers arranged adjacent to one another and over which said textile conveyor belt is trained.

6. The apparatus according to claim 5, wherein the diameter of said first deflector roller is less than about 20 mm.

7. The apparatus according to claim 5, wherein the diameter of said first roller is about 6 mm to about 10 mm.

8. The apparatus according to claim 1, wherein said apparatus includes a support rail of triangular cross section having an upper chip-bearing surface adjacent to said gap, said chip-bearing surface lying in a plane tangent to said first deflector roller.

9. The apparatus according to claim 1, wherein said textile conveyor belt gradually curves downward adjacent said first deflector roller.

10. The apparatus according to claim 1, wherein said apparatus includes means for compressing said chips, said compressing means arranged between said depositing means and said first deflector roller to partially cure said bonding agent.

11. The apparatus according to claim 10, wherein said compressing means provide compression to less than 50% of the original volume of said chips.

12. The apparatus according to claim 10, wherein said compressing means provide compression to less than 10% of the original volume of said chips.

13. The apparatus according to claim 10, wherein said apparatus includes a heating device for preheating said chips mounted between said depositing means and said compressing means.

14. The apparatus according to claim 13, wherein said heating device heats said chips to a temperature of about 50° C. to about 60° C.

15. The apparatus according to claim 1, wherein said apparatus includes means for feeding a paper strip upward onto said steel belt adjacent said gap.

16. The apparatus according to claim 15, wherein said paper strip is upwardly trained around a third deflector roller and continues beyond said third deflector roller in an upward direction until said paper strip reaches said steel belt.

17. The apparatus according to claim 1, wherein said apparatus includes means for feeding a paper strip downward onto said steel belt adjacent said gap.

18. The apparatus according to claim 17, wherein said paper strip is downwardly trained around a third deflector roller and continues beyond said third deflector roller in a downward direction until said paper strip reaches said steel belt.

19. In an apparatus for the continuous manufacture of an endless strip of thin chipboard having a horizontally-disposed pretensioned conveyor belt; means for depositing wood chips mixed with a bonding agent onto a horizontal section of said conveyor belt; a heated compression drum adjacent the discharge end of said conveyor belt;

an endless steel belt encircling a portion of the drum surface to provide a compression gap between the steel belt and the drum surface; and a counter-roller providing pressure against said steel belt and said drum surface, the improvement comprising:

a first deflector roller mounted adjacent the point where said chips enter said gap;

a second deflector roller beneath said depositing means; and said conveyor belt being endless, made from textile material and trained around said first and second deflector rollers to convey said deposited chips to said gap, wherein said conveyor belt and the portion of said counter-roller located between the discharge end of said conveyor belt and the compression gap define a support path for said chips, said conveyor belt and said portion of said counter-roller being in close proximity to each other such that said support path forms a substantially continuous arcuately curved surface that supports said chips at substantially all times as said chips are conveyed from said conveyor belt to said gap;

a support rail of triangular cross section having an upper chip-bearing surface adjacent to said gap, said chip-bearing surface lying in a plane tangent to said first deflector roller, wherein said support rail includes a cooling channel through which a coolant is circulated.

20. The apparatus according to claim 19, wherein said coolant comprises water.

* * * * *